US008550662B2

(12) United States Patent
Hu

(10) Patent No.: US 8,550,662 B2
(45) Date of Patent: Oct. 8, 2013

(54) LIGHT SOURCE MODULE

(76) Inventor: Xiaoping Hu, Guangdong (CN)

( * ) Notice: Subject to any disclaimer, the term of this patent is extended or adjusted under 35 U.S.C. 154(b) by 21 days.

(21) Appl. No.: 13/071,507

(22) Filed: Mar. 25, 2011

(65) Prior Publication Data

US 2012/0243233 A1 Sep. 27, 2012

(51) Int. Cl.
*F21V 21/00* (2006.01)

(52) U.S. Cl.
USPC ..... 362/249.06; 362/249.02; 362/249.14

(58) Field of Classification Search
USPC ..... 362/249.01, 249.02, 249.06, 249.14
See application file for complete search history.

(56) References Cited

U.S. PATENT DOCUMENTS 1,758,179 A * 5/1930 Snavely ..... 246/473.3
6,135,612 A * 10/2000 Clore ..... 362/184
6,857,767 B2 * 2/2005 Matsui et al. ..... 362/373
7,066,626 B2 * 6/2006 Omata ..... 362/257
7,140,751 B2 * 11/2006 Lin ..... 362/249.02
7,547,115 B2 * 6/2009 Chou ..... 362/244
7,581,853 B2 * 9/2009 Kim et al. ..... 362/307
7,993,021 B2 * 8/2011 Roberts et al. ..... 362/97.3
8,093,600 B2 * 1/2012 Li et al. ..... 257/79
2007/0014098 A1 * 1/2007 Park et al. ..... 362/29
2007/0274069 A1 * 11/2007 Chou ..... 362/244
2009/0154160 A1 * 6/2009 Li et al. ..... 362/249.02

* cited by examiner

*Primary Examiner* — John A Ward
(74) *Attorney, Agent, or Firm* — Global IP Services; Tianhua Gu

(57) ABSTRACT

The light source module provided by the present invention includes a base plate and a plurality of LED lights arranged on the base plate. These LED lights are distributed on the base plate in such manner that all of the light centers of the LED lights define together a triangle shape. An angle of 50-70 degree is defined between a LED light and two adjacent LED lights. The present invention has many advantages. For example, because the LED lights are distributed in a triangle arrangement, the dark regions are reduced effectively. Moreover, alternative dark and bright strips are eliminated. In addition, the base plates can be assembled quickly by means of the connective members.

6 Claims, 6 Drawing Sheets

LIGHT SOURCE MODULE

CROSS REFERENCE TO RELATED PATENT APPLICATION

The present application claims the priority of the Chinese patent application No. 201010191877.5 filed on May 31, 2010, which application is incorporated herein by reference.

FIELD OF THE INVENTION

The invention relates to an energy-saving light source and more particularly, relates to a light source consisted of a plurality of LED lights.

BACKGROUND OF THE INVENTION

It is a major means to improve and promote reputation and brands of a company by using advertisement lamp-boxes. Conventional advertisement lamp-boxes appear in many public areas such as bus stations, harbors and airports.

Light intensity of a tube inside the lamp-box gets worse and worse when the distance increases. As a result, dark and bright light strips are easily shown on surfaces of the lamp-box in an alternative manner. To eliminate these alternatively shown light strips, the number and light intensity of the tubes are necessarily increased, hence resulting in significant consumption of energy and increase of the cost. With the development of technologies, energy-saving LED lights are utilized. A plural LED lights are installed together to replace above conventional light tubes. However, these newly emerging LED lights still fail to eliminate alternative light strips, as shown in FIG. 1. Attempts have been made to overcome above problem by arranging the LED lights so that they have a cellular or square arrangement (as shown in FIGS. 3 and 5). These cellular or square arrangements failed to completely overcome the above issue and further resulted in other drawbacks such as large area of dark strip (as shown in FIGS. 2, 4 and 6).

SUMMARY OF THE INVENTION

To overcome above drawbacks of prior art, a light source module is provided which has minimum area of dark region, eliminates the alternative dark and bright strips, and is easy to be assembled together.

The light source module provided by the present invention includes a base plate and a plurality of LED lights arranged on the base plate. These LED lights are distributed on the base plate in such manner that all of the light centers of the LED lights define together a triangle shape. An angle of 50-70 degree is defined between a LED light and two adjacent LED lights.

Preferably, the above angle is 60 degree such that an equilateral triangle is formed.

These LED light are distributed so that they have identical distances one another.

The effective light coverage between two LED lights takes on a circular shape and these coverages are tangential one another at peripheries thereof. A virtual light source is formed between two adjacent LED lights and defines a dark region of a shape similar to triangle.

The base plate has a first and second connective members provided on its undersurface. The first connective member has a first insertion pin provided thereon. The second connective member has a second insertion pin equipped thereon. The first and second insertion pins are orientated in opposite directions.

The first and second insertion pins are inserted into chambers defined respectively in the first and second connective members so as to assemble the base plates together. The sidewalls of the first and second insertion pins are pressed against to each other in order to limit the position.

The present invention has many advantages. For example, because the LED lights are distributed in a triangle arrangement, the dark regions are reduced effectively. Moreover, alternative dark and bright strips are eliminated. In addition, the base plates can be assembled quickly by means of the connective members. Other advantages and novel features will be drawn from the following detailed description of embodiments with attached drawings, in which:

DETAIL DESCRIPTION OF THE INVENTION

Various embodiments of the invention will now be discussed in conjunction with the drawings.

Figure 1:
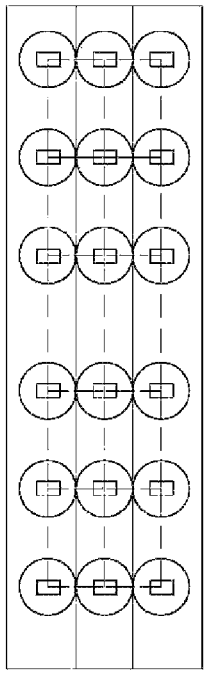
FIG. 1(Prior Art)
FIG. 1 shows a structural view of prior art light source.
Figure 2:
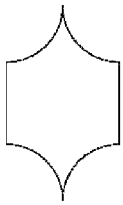
FIG. 2(Prior Art)
FIG. 2 shows schematically the dark regions of the light source of FIG. 1.
Figure 3:
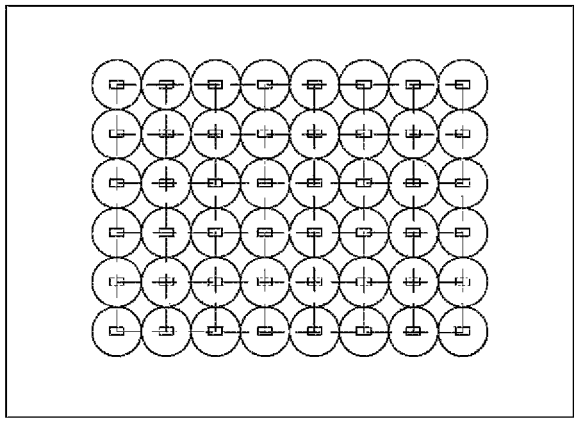
FIG. 3(Prior Art)
FIG. 3 shows another structural view of prior art light source.
Figure 4:
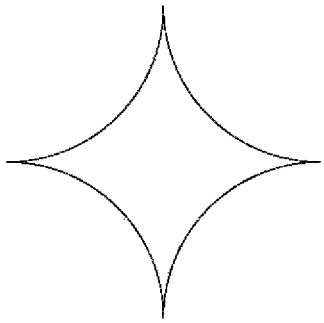
FIG. 4(Prior Art)
FIG. 4 shows schematically the dark regions of the light source of FIG. 3.
Figure 5:
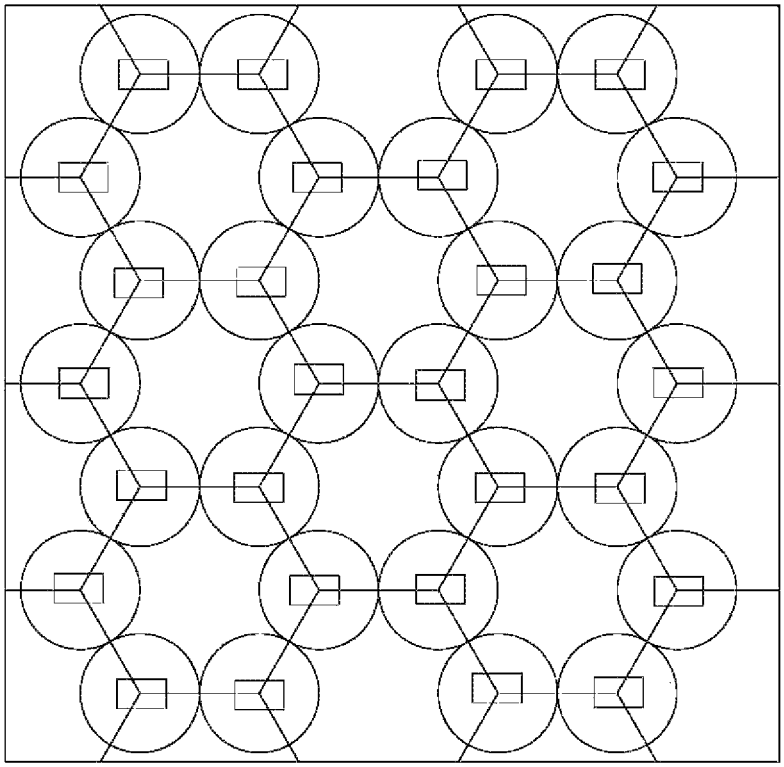
FIG. 5(Prior Art)
FIG. 5 shows a further structural view of prior art light source.
Figure 6:
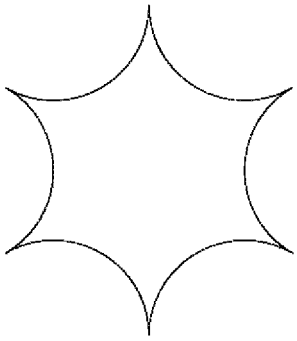
FIG. 6(Prior Art)
FIG. 6 shows schematically the dark regions of the light source of FIG. 5.
Figure 7:
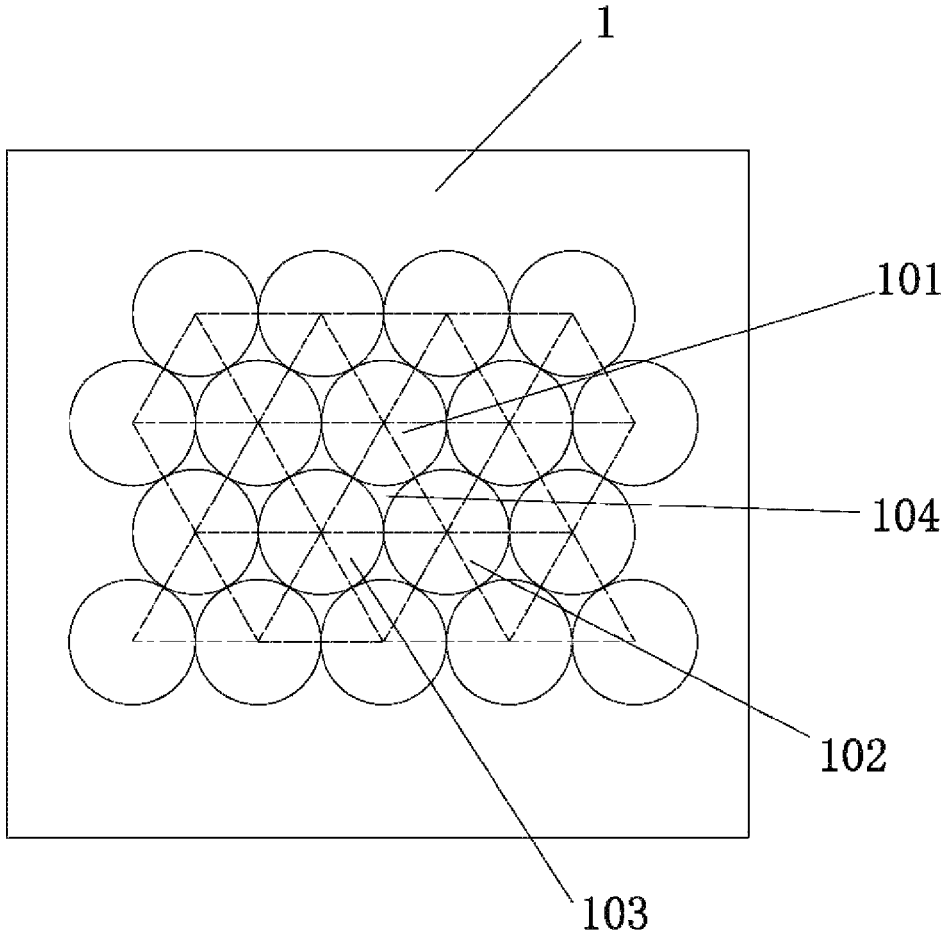
FIG. 7 shows a light source according to the present invention.

As shown in FIG. 7, a light source module according to one embodiment of the invention includes a base plate 1 and a plurality of LED lights 101-103 installed on the base plate 1. The LED lights 101-103 are arranged in such manner that the light source centers of these LED lights 101-103 define collectively a triangle shape. An angle of 50-70 degree is defined between each LED light and two adjacent LED lights.

The effective light coverages among the LED lights 101-103 takes on a circular shape and these coverages are tangential one another at peripheries thereof. A virtual light source is formed among the LED lights 101-103 and defines a dark region 104 of a shape similar to triangle.

Preferably, the angles defined among these LED lights 101-103 are 60 degree such that an equilateral triangle is defined. These LED light are distributed so that they have identical distances one another.

Figure 11:
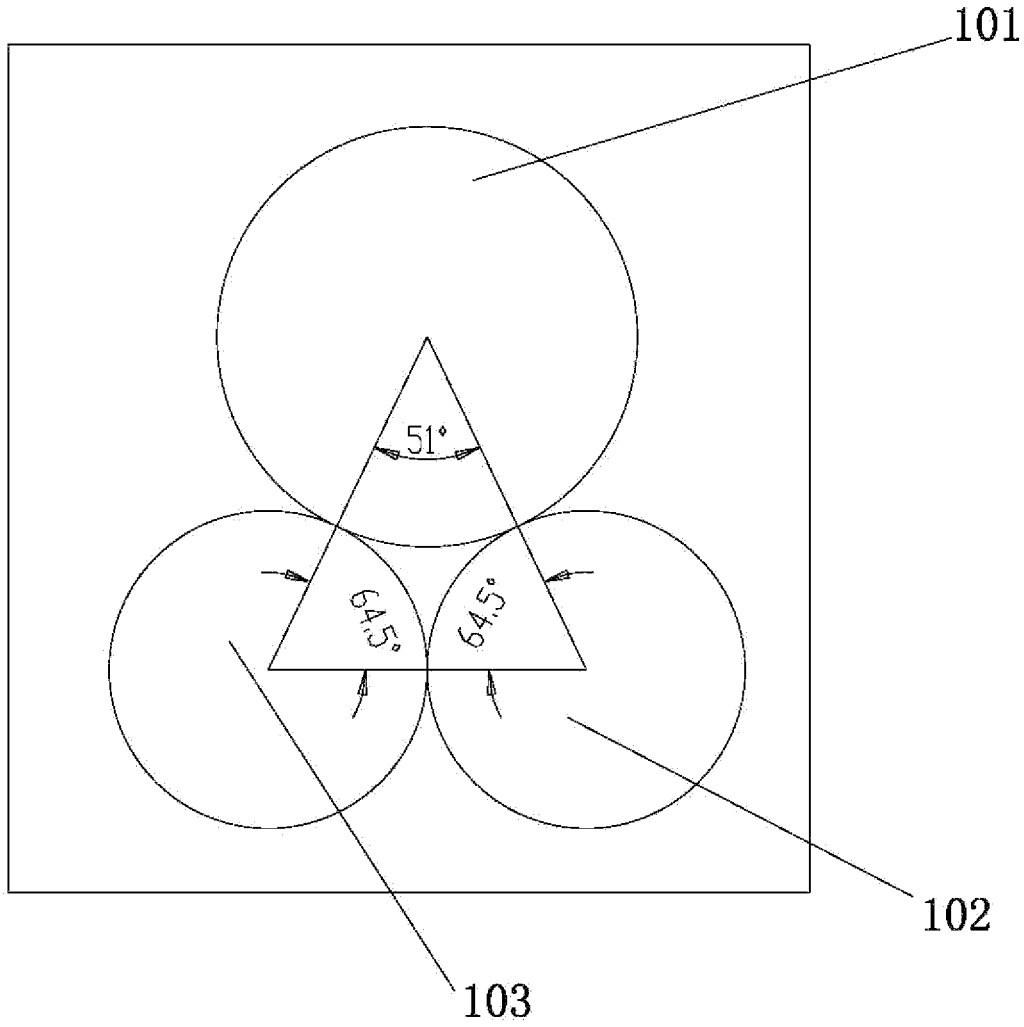
FIG. 11 shows another light source according to the present invention.

As shown in FIG. 11, a light source module according to another embodiment of the invention is illustrated in a schematic manner. The light source shown in FIG. 11 contains a plurality of LED lights 101-103 which are arranged in such a manner that three angles are defined among them. These angles may be 51 degree, 64.5 degree and 64.5 degree respectively.

Figure 9:
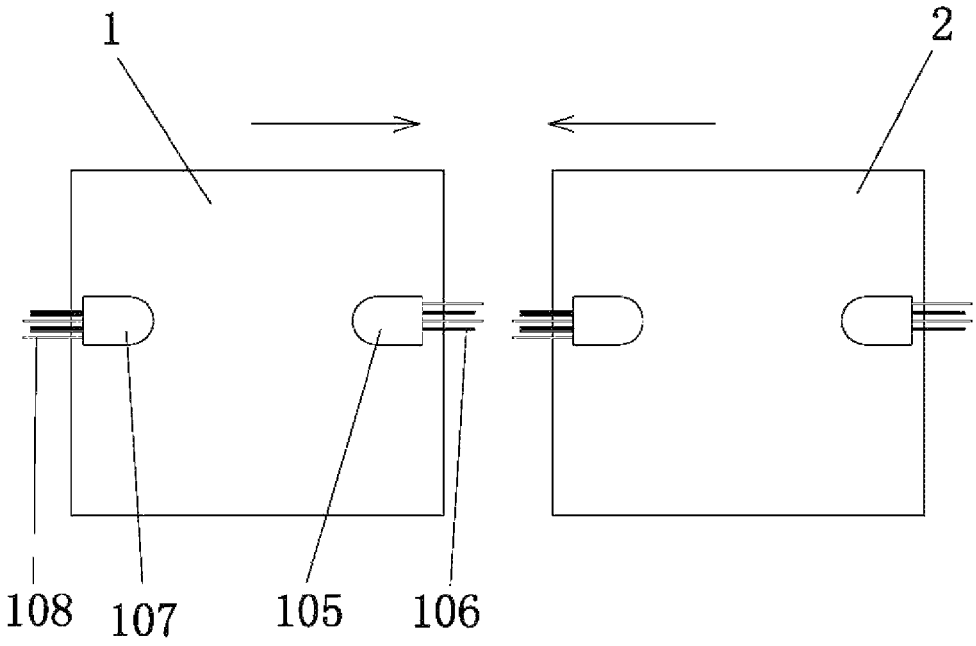
FIGS. 9 and 10 illustrate a process of assembling a plurality of base plates according to the invention.
Figure 10:
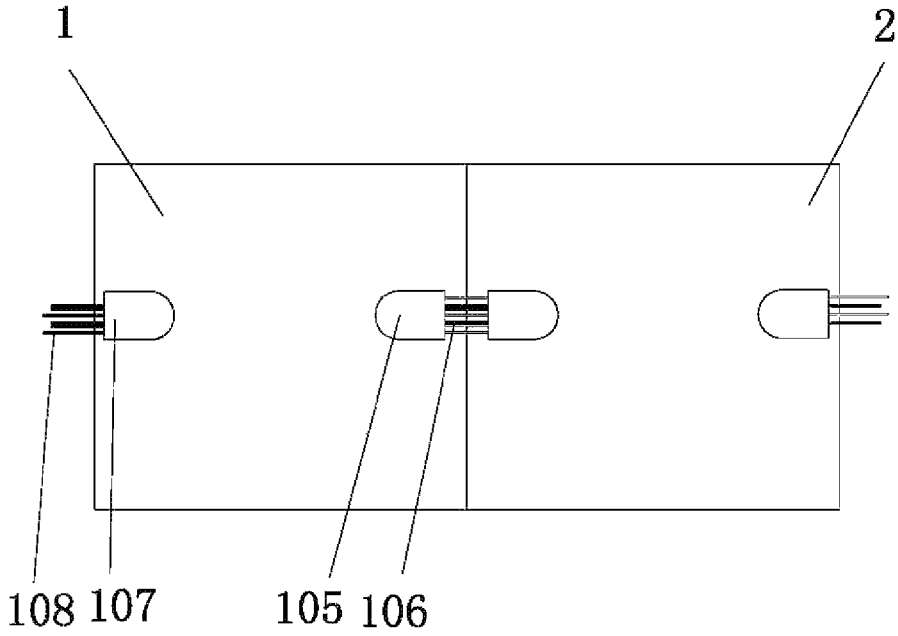

As shown in FIGS. 9-10. The base plate 1 has a first and second connective members 105 and 107 provided on its undersurface. The first connective member 105 has a first insertion pin 106 provided thereon. The second connective member 107 has a second insertion pin 108 equipped thereon. The first and second insertion pins 106 and 108 are orientated in opposite directions.

Figure 8:
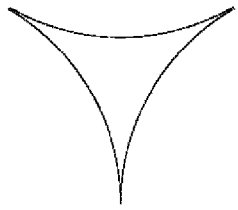
FIG. 8 shows schematically the dark regions of the light source of the invention.

The first and second insertion pins 106, 108 are inserted into chambers defined respectively in the first and second connective members 105, 107 so as to assemble the base plates 1 together. The sidewalls of the first and second insertion pins 106, 108 are pressed against to each other in order to limit the position. As shown in FIG. 8, the dark region 104 is of a triangle when these LED lights is lit. Clearly, the area of the dark region 104 is significantly smaller than that of the LED lights with a cellular arrangement or rectangular arrangement.

The base plates 1 may be assembled effectively using the above connective members 105, 107 so as to form a large group of base plate.

What is claimed is:

1. A light source module for assembling a plan light source which can evenly issue light from every point of the plan comprising:

a base plate (1);

a plurality of lines of LED lights (101, 102, 103 - - - ) arranged on the base plate (1) to form an array of LED lights; and the LED lights (101, 102, 103 - - - ) of the array are distributed on the base plate (1) in even manner that three adjacent light centers of the LED lights (101, 102, 103 - - - ) define a triangle, and an angle of 50-70 degree is defined by a LED light and two adjacent LED lights.

2. The light source module as described in claim 1, wherein the angle defined by a LED light and two adjacent LED lights is 60 degree, the three light centers of the three adjacent lights form an equilateral triangle.

3. The light source module as described in claim 2, wherein distances between any two adjacent LED lights are the same.

4. The light source module as described in claim 3, wherein effective light coverage of the LED lights (101, 102, 103 - - - ) are circular shapes and these coverages are tangential one to another at peripheries thereof; and a virtual light source is formed among three adjacent LED lights, the virtual light source is a dark region (104) having a shape similar to triangle.

5. The light source module as described in claim 1, wherein the base plate (1) has a first and second connective members (105, 107) provided on an undersurface of the base plate (1); the first connective member (105) has a first insertion pin (106) provided thereon; while the second connective member (107) has a second insertion pin (108) equipped thereon; and the first and second insertion pins (106, 108) are orientated in opposite directions.

6. The light source module as described in claim 5, wherein the first and second insertion pins (106, 108) are inserted into chambers defined respectively in the first and second connective members (105, 107) so as to assemble two base plates (1 and 2) together.

* * * * *